US010393332B2

(12) United States Patent
Patton

(10) Patent No.: US 10,393,332 B2
(45) Date of Patent: Aug. 27, 2019

(54) ELECTRIC CANDLE HAVING FLICKERING EFFECT

(71) Applicant: L & L Candle Company, LLC, Eden Prarie, MN (US)

(72) Inventor: Douglas Patton, Irvine, CA (US)

(73) Assignee: L & L Candle Company, LLC, Eden Prarie, MN (US)

( * ) Notice: Subject to any disclaimer, the term of this patent is extended or adjusted under 35 U.S.C. 154(b) by 0 days.

(21) Appl. No.: 15/958,873

(22) Filed: Apr. 20, 2018

(65) Prior Publication Data

US 2018/0306396 A1 Oct. 25, 2018

Related U.S. Application Data

(60) Provisional application No. 62/487,569, filed on Apr. 20, 2017.

(51) Int. Cl.

| | |
|---|---|
| ***F21S 10/04*** | (2006.01) |
| ***F21S 6/00*** | (2006.01) |
| ***F21K 9/235*** | (2016.01) |
| ***F21V 19/00*** | (2006.01) |
| ***F21K 9/238*** | (2016.01) |

(Continued)

(52) U.S. Cl.

CPC ..... *F21S 10/046* (2013.01); *F21K 9/235* (2016.08); *F21K 9/238* (2016.08); *F21S 6/001* (2013.01); *F21V 19/0055* (2013.01); *F21W 2121/00* (2013.01); *F21Y 2115/10* (2016.08)

(58) Field of Classification Search

CPC ..... F21S 10/046; F21S 6/001; F21K 9/238; F21K 9/235; F21V 19/0055

See application file for complete search history.

(56) References Cited

U.S. PATENT DOCUMENTS

| | | | |
|---|---|---|---|
| 782,156 | A | 2/1905 | Meeker |
| 817,772 | A | 4/1906 | Helmer |

(Continued)

FOREIGN PATENT DOCUMENTS

| | | |
|---|---|---|
| CN | 1030823 | 2/1989 |
| CN | 2483103 | 3/2002 |

(Continued)

OTHER PUBLICATIONS

U.S. Appl. No. 15/411,869, filed Jan. 20, 2017, Li.

(Continued)

*Primary Examiner* — Anabel Ton

(74) *Attorney, Agent, or Firm* — Law Office of Scott C Harris, Inc

(57) ABSTRACT

An electronic lighting device and a method for manufacturing the same are disclosed. A housing is formed for the light source support inside the housing. The light source support holds a light source that shines light onto a flame element. The flame element has an upper part shaped like a flame and a lower part extending in the opposite direction from the upper part allowing the flame element to move like a pendulum. The upper part can include a spherical ball that fits into a recess and the housing, and moves back and forth while being illuminated by the light source. In one embodiment, there is a circuit board in the housing, and the light source, as wealth an electromagnet to move the pendulum can both be mounted on the circuit board.

9 Claims, 12 Drawing Sheets

(51) Int. Cl.
*F21Y 115/10* (2016.01)
*F21W 121/00* (2006.01)

(56) References Cited

U.S. PATENT DOCUMENTS 1,507,371 A 8/1924 Goodridge
1,842,167 A 1/1932 Hall
1,955,042 A 4/1934 Work
D102,561 S 12/1936 Lamb
2,435,811 A 2/1948 Waters
2,932,351 A 6/1958 Bried
2,976,450 A 3/1961 Benoliel
2,984,032 A 5/1961 Cornell
3,166,863 A 1/1965 Gray
3,233,093 A 2/1966 Gerlat
3,373,274 A 3/1968 Kott
3,384,774 A 5/1968 English
3,425,157 A 2/1969 Hartsock
3,479,561 A 11/1969 Janning
3,514,660 A 5/1970 Kopelman
3,603,013 A 9/1971 Gardiner
3,639,749 A 2/1972 Beckman
3,681,588 A 8/1972 Lee
3,814,973 A 6/1974 Thouret et al.
3,890,085 A 6/1975 Andeweg
4,026,544 A 5/1977 Plambeck et al.
4,067,111 A 1/1978 Truitt
4,187,532 A 2/1980 Naffier
4,328,534 A 5/1982 Abe
4,477,249 A 10/1984 Ruzek et al.
4,550,363 A 10/1985 Sandell
4,551,794 A 11/1985 Sandell
4,617,614 A 10/1986 Lederer
4,728,871 A 3/1988 Andrews
4,764,853 A 8/1988 Thomas
4,777,571 A 10/1988 Morgan
4,866,580 A 9/1989 Blackerby
4,965,707 A 10/1990 Butterfield
5,072,208 A 12/1991 Christensen
5,097,180 A 3/1992 Ignon et al.
5,152,602 A 10/1992 Boschetto
5,381,325 A 1/1995 Messana
5,550,452 A 8/1996 Shirai
5,582,478 A 12/1996 Ambrosino
5,707,282 A 1/1998 Clements et al.
5,924,784 A 7/1999 Chliwnyj et al.
5,936,521 A 8/1999 Blackman
6,198,229 B1 3/2001 McCloud
6,241,362 B1 6/2001 Morrison
6,257,755 B1 7/2001 Sevelle
6,302,555 B1 10/2001 Bristow
6,312,137 B1 11/2001 Hsieh
6,454,425 B1 9/2002 Lin
6,461,011 B1 10/2002 Harrison
6,491,516 B1 12/2002 Tal et al.
6,511,219 B2 1/2003 Sevelle
D486,924 S 2/2004 Skradski et al.
6,688,752 B2 2/2004 Moore
6,712,493 B2 3/2004 Tell et al.
6,757,487 B2 6/2004 Martin et al.
6,781,270 B2 8/2004 Long
6,953,401 B2 10/2005 Starr
6,955,440 B2 10/2005 Niskanen
6,966,665 B2 11/2005 Limburg et al.
7,029,146 B2 4/2006 Kitchen
7,066,637 B2 6/2006 Nozawa et al.
7,080,472 B2 7/2006 Schroeter et al.
7,083,315 B2 8/2006 Hansler et al.
7,093,949 B2 8/2006 Hart et al.
7,111,421 B2 9/2006 Corry et al.
7,118,243 B2 10/2006 McCavit et al.
7,125,142 B2 10/2006 Wainwright
7,159,994 B2 1/2007 Schnuckle et al.
D545,458 S 6/2007 Jensen
7,261,455 B2 8/2007 Schnuckle et al.
7,300,179 B1 11/2007 LaDuke et al.
7,305,783 B2 12/2007 Mix et al.
D567,993 S 4/2008 Shiu
7,350,720 B2 4/2008 Jaworski et al.
7,360,935 B2 4/2008 Jensen et al.
7,410,269 B2 8/2008 Harrity
D576,317 S 9/2008 Jensen
7,481,571 B2 1/2009 Bistritzky et al.
D589,176 S 3/2009 Huang et al.
7,503,668 B2 3/2009 Porchia et al.
D599,491 S 9/2009 Luo
7,633,232 B2 12/2009 Wong
7,686,471 B2 3/2010 Reichow
RE41,628 E 9/2010 Barbeau
7,824,627 B2 11/2010 Michaels et al.
7,828,462 B2 11/2010 Jensen et al.
7,837,355 B2 11/2010 Schnuckle
8,070,319 B2 12/2011 Schnuckle et al.
8,081,872 B2 12/2011 Wang
8,132,936 B2 3/2012 Patton et al.
8,210,708 B2 7/2012 Hau et al.
8,235,558 B1 8/2012 Lauer
8,256,935 B1 9/2012 Cullimore et al.
8,342,712 B2 1/2013 Patton et al.
8,454,190 B2 6/2013 Negron
8,534,869 B2 9/2013 Patton et al.
8,550,660 B2 10/2013 Patton et al.
8,646,946 B2 2/2014 Schnuckle et al.
8,696,166 B2 4/2014 Patton et al.
8,721,118 B2 5/2014 Patton
8,727,569 B2 5/2014 Schnuckle et al.
8,789,986 B2 7/2014 Li
8,894,261 B2 11/2014 Chen
8,926,137 B2 1/2015 Li
8,998,461 B2 4/2015 Gutstein et al.
9,033,553 B2 5/2015 Li
9,052,078 B2 6/2015 Sheng
D740,460 S 10/2015 Thompson et al.
D743,096 S 11/2015 Patton et al.
D748,322 S 1/2016 Patton et al.
D748,843 S 2/2016 Thompson et al.
D752,276 S 3/2016 Thompson et al.
9,322,523 B2 4/2016 Patton et al.
9,335,014 B2 5/2016 Li
9,360,181 B2 6/2016 Li
9,366,402 B2 6/2016 Li
9,371,972 B2 6/2016 Li
9,371,973 B2 6/2016 Li
9,541,247 B2 1/2017 Patton
D779,707 S 2/2017 Thompson et al.
9,572,236 B2 2/2017 Patton
D781,488 S 3/2017 Patton
9,585,980 B1 * 3/2017 Li ..... F21S 6/001
9,591,729 B2 3/2017 Patton
9,605,824 B1 3/2017 Li
9,625,112 B2 4/2017 Li
9,810,388 B1 * 11/2017 Li ..... F21S 6/001
2001/0033488 A1 10/2001 Chliwnyj et al.
2002/0080601 A1 6/2002 Meltzer
2003/0041491 A1 3/2003 Mix
2003/0053305 A1 3/2003 Lin
2003/0072154 A1 4/2003 Moore
2004/0114351 A1 6/2004 Stokes et al.
2004/0165374 A1 8/2004 Robinson
2004/0223326 A1 11/2004 Wainwright
2005/0007779 A1 1/2005 Nozawa
2005/0097792 A1 5/2005 Naden
2005/0169666 A1 8/2005 Porchia et al.
2005/0169812 A1 8/2005 Helf
2005/0196716 A1 9/2005 Haab
2005/0225984 A1 10/2005 Theobald
2005/0254248 A1 11/2005 Lederer
2005/0285538 A1 12/2005 Jaworski et al.
2006/0034079 A1 2/2006 Schnuckle et al.
2006/0034100 A1 2/2006 Schnuckle et al.
2006/0039835 A1 2/2006 Nottingham et al.
2006/0101681 A1 5/2006 Hess et al.
2006/0120080 A1 6/2006 Sipinski et al.
2006/0125420 A1 6/2006 Boone

(56) References Cited

U.S. PATENT DOCUMENTS

2006/0146544 A1 7/2006 Leung
2006/0192503 A1 8/2006 Trombetta et al.
2007/0002560 A1 1/2007 Gutstein et al.
2007/0053174 A1 3/2007 Lin
2007/0127249 A1 6/2007 Medley et al.
2007/0154857 A1 7/2007 Cho
2007/0159422 A1 7/2007 Blandino et al.
2007/0223217 A1 9/2007 Hsu
2007/0236947 A1 10/2007 Jensen et al.
2008/0031784 A1 2/2008 Bistritzky et al.
2008/0038156 A1 2/2008 Jaramillo
2008/0074875 A1 3/2008 Jensen et al.
2008/0112154 A1 5/2008 Reichow
2008/0129226 A1 6/2008 DeWitt et al.
2008/0130266 A1 6/2008 DeWitt et al.
2008/0150453 A1 6/2008 Medley et al.
2008/0151563 A1 6/2008 Chen
2008/0151571 A1 6/2008 Tang
2009/0059596 A1 3/2009 Lederer
2009/0135586 A1 5/2009 Yang
2010/0001662 A1 1/2010 Nelkin
2010/0001682 A1 1/2010 Dickson et al.
2010/0079999 A1 4/2010 Schnuckle
2010/0134022 A1 6/2010 Gutstein et al.
2010/0207538 A1 8/2010 Chen
2011/0000666 A1 1/2011 Couto
2011/0019422 A1 1/2011 Schnuckle
2011/0027124 A1 2/2011 Albee et al.
2011/0110073 A1 5/2011 Schnuckle et al.
2011/0127914 A1* 6/2011 Patton ..... F21S 10/04 315/76
2011/0134628 A1 6/2011 Pestl et al.
2011/0195787 A1 8/2011 Wells
2011/0204828 A1 8/2011 Moody et al.
2011/0317403 A1 12/2011 Fournier et al.
2012/0020052 A1 1/2012 McCavit et al.
2012/0024837 A1 2/2012 Thompson
2012/0049765 A1 3/2012 Lu
2012/0093491 A1 4/2012 Browder et al.
2012/0134157 A1 5/2012 Li
2013/0050985 A1 2/2013 Kwok et al.
2013/0163249 A1 6/2013 Miura
2013/0223043 A1 8/2013 Ray
2013/0265748 A1 10/2013 Negron
2014/0035483 A1 2/2014 Becker
2014/0140042 A1 5/2014 Schreiber
2014/0211458 A1* 7/2014 Lai ..... F21V 35/00 362/161
2014/0211499 A1 7/2014 Fong
2014/0218903 A1 8/2014 Sheng
2014/0241004 A1* 8/2014 Chen ..... F21S 10/04 362/569
2014/0254148 A1 9/2014 Fournier
2014/0268652 A1 9/2014 Li
2014/0268704 A1 9/2014 Yang
2014/0274212 A1 9/2014 Zurek et al.
2014/0286024 A1 9/2014 Li
2014/0313694 A1 10/2014 Patton
2014/0362592 A1 12/2014 Lee
2015/0008845 A1 1/2015 Kim
2015/0036348 A1* 2/2015 Dong ..... F21S 10/046 362/293
2015/0070874 A1 3/2015 Beesley
2015/0109786 A1 4/2015 Li
2015/0124442 A1 5/2015 Ding
2015/0233538 A1 8/2015 Sheng
2015/0292698 A1 10/2015 Li
2015/0308643 A1 10/2015 Huang
2015/0369431 A1 12/2015 Li
2015/0369432 A1 12/2015 Li
2015/0373815 A1 12/2015 Patton
2016/0040844 A1 2/2016 Patton
2016/0047517 A1 2/2016 Li
2016/0057829 A1 2/2016 Li
2016/0109082 A1 4/2016 Li
2016/0109083 A1* 4/2016 Li ..... F21S 10/046 362/84
2016/0163630 A1 6/2016 Kummerl
2016/0186947 A1 6/2016 Li
2016/0258584 A1 9/2016 Li
2016/0290580 A1 10/2016 Li
2016/0298816 A1* 10/2016 Fang ..... F21S 10/046
2017/0067606 A1 3/2017 Li
2017/0211767 A1* 7/2017 Baeza ..... F21S 6/001
2017/0307159 A1* 10/2017 Li ..... F21S 10/046
2017/0367163 A1* 12/2017 Li ..... H05B 37/0272

FOREIGN PATENT DOCUMENTS

CN 2551859 5/2003
CN 2562059 Y 7/2003
CN 1530142 A 9/2004
CN 1646177 A 7/2005
CN 2854329 Y 1/2007
CN 2888274 Y 4/2007
CN 2924266 7/2007
CN 200940808 Y 8/2007
CN 201011621 Y 1/2008
CN 201059432 Y 5/2008
CN 201093300 7/2008
CN 201103952 Y 8/2008
CN 201159425 Y 12/2008
CN 101408284 A 4/2009
CN 201235095 Y 5/2009
CN 201418887 Y 3/2010
CN 201533921 U 7/2010
CN 101865413 A 10/2010
CN 201643048 U 11/2010
CN 102147095 A 8/2011
CN 102563510 A 7/2012
CN 102734740 A 10/2012
CN 102748589 A 10/2012
CN 202708962 U 1/2013
CN 202791780 U 3/2013
CN 203131550 8/2013
CN 103322500 A 9/2013
CN 20329818 U 11/2013
CN 203273669 11/2013
CN 203273670 U 11/2013
CN 203431703 U 2/2014
CN 203442498 U 2/2014
CN 203517611 U 4/2014
CN 203571618 U 4/2014
CN 104048246 9/2014
CN 104089241 10/2014
CN 203940346 11/2014
CN 204268356 4/2015
DE 1489617 A1 5/1969
DE 212011100014 U1 4/2012
DE 102012206988 A1 10/2013
DE 202014100821 U1 4/2014
DE 202013012047 4/2015
DE 202015000490 4/2015
DE 202015102274 6/2015
EP 0138786 A1 4/1985
EP 0855189 A2 7/1998
EP 1639291 B1 3/2006
EP 1838110 A1 9/2007
EP 2587127 A1 5/2013
GB 499745 1/1939
GB 2230335 10/1990
GB 2267746 12/1993
GB 2323159 A 9/1998
GB 2379731 A 3/2003
GB 2385413 A 8/2003
GB 2443926 5/2008
GB 2455598 A 6/2009
GB 2527626 12/2015
JP H0652709 2/1994
JP H1057464 A 3/1998
JP 2000284730 A 10/2000
JP 2008180755 A 8/2008
KR 101174246 8/2012
WO WO-1982002756 A1 8/1982

(56) References Cited

FOREIGN PATENT DOCUMENTS

| | | | |
|---|---|---|---|
| WO | WO-1985003561 | A1 | 8/1985 |
| WO | WO-1987004506 | A1 | 7/1987 |
| WO | WO-1996025624 | A1 | 8/1996 |
| WO | WO-2001092780 | | 12/2001 |
| WO | WO-2003011349 | | 2/2003 |
| WO | WO-2006020839 | A2 | 2/2006 |
| WO | WO2007002560 | A1 | 1/2007 |
| WO | WO-2008092753 | A2 | 8/2008 |
| WO | WO-2010009575 | | 1/2010 |
| WO | WO-2012000418 | A1 | 1/2012 |
| WO | WO2012099718 | | 7/2012 |
| WO | WO2012162538 | A1 | 11/2012 |
| WO | WO-2013020263 | A2 | 2/2013 |
| WO | WO2013020439 | | 2/2013 |
| WO | WO2014139483 | A1 | 9/2014 |
| WO | WO2016000517 | A1 | 1/2016 |

OTHER PUBLICATIONS

U.S. Appl. No. 15/413,305, filed Jan. 23, 2017, Li.
U.S. Appl. No. 15/150,057, filed May 9, 2016, Li.
U.S. Appl. No. 15/322,237, filed Nov. 18, 2014, Li.
U.S. Appl. No. 15/418,451, filed Jan. 27, 2017, Li.
U.S. Appl. No. 15/441,143, filed Feb. 23, 2017, Li.
U.S. Appl. No. 15/451,351, filed Mar. 6, 2017, Li.
U.S. Appl. No. 15/368,168, filed Dec. 2, 2016, Li.
U.S. Appl. No. 15/451,361, filed Mar. 6, 2017, Li.
Non-Final Office Action for U.S. Appl. No. 15/197,354, dated Jan. 19, 2017, 36 pages.
Notice of Allowance for U.S. Appl. No. 15/137,951 dated Feb. 28, 2017, 10 pages.
Non-Final Office Action for U.S. Appl. No. 15/368,168, dated Mar. 13, 2017, 36 pages.
Translated Office Action issued by the German patent and Trade Mark Office dated Mar. 16, 2017 for Application No. 102016008825.7, 8 pages.
Non-Final Office Action for U.S. Appl. No. 15/355,408, dated Feb. 8, 2017, 26 pages.
Notice of Allowance for U.S. Appl. No. 14/672,819, dated Jan. 27, 2017, 14 pages.
Translated Office Action issued by the German patent and Trade Mark Office dated Feb. 16, 2017 for Application No. 102016008226.7, 6 pages.
Translated Office Action issued by the German patent and Trade Mark Office dated Mar. 2, 2017 for Application No. 102016009125.8, 5 pages.
MiPow Playbulb Candle, Android, http://www.mipow.de/smart-home/29/mipow-playbulb-candle, archived on http://www.archive.org on May 14, 2016 [accessed Mar. 2, 2017].
CHIP: Progimax Candle, http://beste-apss.chip.de/android/app/kostenloses-candle-kerzen-app-fuer-den-androiden.com.progimax.candle.free/ , archived on http://www.archive.org on Dec. 30, 2013 [accessed on Mar. 2, 2017].
Notice of Allowance for U.S. Appl. No. 15/158,508 dated Sep. 21, 2016, 8 pages.
Notice of Allowance for U.S. Appl. No. 15/061,648, dated Sep. 23, 2016, 9 pages.
Non-Final Office Action for U.S. Appl. No. 15/137,951, dated Oct. 24, 2016, 28 pages.
UK Combined Search and Examination Report for GB1613387.8, dated Sep. 9, 2016, 10 pages.
UK Combined Search and Examination Report for GB1613393.6, dated Sep. 9, 2016, 10 pages.
Canadian Examination and Search Report for CA2936224, dated Sep. 30, 2016, 5 pages.
UK Combined Search and Examination Report for GB1613391.0, dated Sep. 19, 2016, 9 pages.
Notice of Allowance for U.S. Appl. No. 14/449,865 dated Nov. 16, 2016, 15 pages.
Notice of Allowance for U.S. Appl. No. 15/145,739 dated Nov. 17, 2016, 11 pages.
Notice of Allowance for U.S. Appl. No. 15/187,618 dated Nov. 30, 2016, 12 pages.
Canadian Examination and Search Report for CA2936225, dated Sep. 29, 2016, 5 pages.
Non-Final Office Action for U.S. Appl. No. 15/371,103, dated Jan. 25, 2017, 45 pages.
Notice of Allowance for Canadian Patent Application No. 2,930,065, dated Feb. 9, 2017 from the Canadian Intellectual Property Office.
Canadian Examination Report for CA2930099, dated Jan. 5, 2017 from the Canadian Intellectual Property Office, 3 pages.
Translated Office Action issued by the German patent and Trade Mark Office dated Dec. 19, 2016 for Application No. 102016008225.9, 5 pages.
Notice of Allowance for U.S. Appl. No. 15/207,411 dated Jan. 20, 2017, 23 pages.
Notice of Allowance for Canadian Patent Application No. 2,936,225, dated Jan. 16, 2017 from the Canadian Intellectual Property Office.
Notice of Allowance for U.S. Appl. No. 15/371,103 dated Apr. 12, 2017, 10 pages.
U.S. Appl. No. 15/132,548, filed Apr. 19, 2016, Li.
U.S. Appl. No. 15/145,739, filed May 3, 2016, Li.
U.S. Appl. No. 15/197,354, filed Jun. 29, 2016, Li.
U.S. Appl. No. 15/137,951, filed Apr. 25, 2016, Li.
U.S. Appl. No. 61/101,611 to Schnuckle, filed Sep. 30, 2008.
U.S. Appl. No. 61/293,516 to Patton, filed Jan. 8, 2010.
International Search Report and Written Opinion for PCT Application No. PCT/CN/2014/073557 dated Jul. 2, 2014.
International Search Report for PCT Application No. PCT/US2009/054401 dated Oct. 26, 2009.
EP Search Report for European Patent Application No. 12185984.7 dated Dec. 14, 2012.
Engineer's Handbook (Epoxy definition), http://engineershandbook.com/Materials/epoxy.htm, Jul. 18, 2013.
Nagashima, H. et al., "Introduction to Chaos, Physics and Mathematics of Chaotic Phenomena," Institute of Physics Publishing, 1999.
Definition of "Electromagnet" in the Encarta World English Dictionary, Aug. 1999.
Lab M3: The Physical Pendulum, Physics 1140—Experimental Physics, Course Laboratory Instructions, 2000.
Non-Final Office Action for U.S. Appl. No. 12/273,337 dated Jun. 17, 2011, 16 pages.
Notice of Allowance for U.S. Appl. No. 12/273,337 dated Mar. 26, 2012, 8 pages.
Final Office Action for U.S. Appl. No. 12/273,337 dated Jan. 18, 2012, 17 pages.
Non-Final Office Action for U.S. Appl. No. 13/526,067 dated Oct. 22, 2012, 23 pages.
Notice of Allowance for U.S. Appl. No. 13/526,067 dated Feb. 6, 2013, 8 pages.
Non-Final Office Action for U.S. Appl. No. 13/908,571 dated Sep. 6, 2013, 11 pages.
Final Office Action for U.S. Appl. No. 13/908,571 dated Mar. 18, 2014, 20 pages.
Final Office Action for U.S. Appl. No. 13/098,571 dated Sep. 30, 2014, 18 pages.
Notice of Allowance for U.S. Appl. No. 13/325,754 dated Jun. 18, 2014, 10 pages.
Non-Final Office Action for U.S. Appl. No. 13/325,754 dated Dec. 30, 2013, 14 pages.
Notice of Allowance for U.S. Appl. No. 14/161,143, dated Nov. 13, 2014, 18 pages.
Non-Final Office Action for U.S. Appl. No. 14/558,507 dated Sep. 20, 2015, 21 pages.
Notice of Allowance for U.S. Appl. No. 14/588,507 dated Dec. 4, 2015, 11 pages.
Non-Final Office Action for U.S. Appl. No. 14/558,507 dated Mar. 17, 2016, 18 pages.
Notice of Allowance for U.S. Appl. No. 14/588,507 dated May 3, 2016, 7 pages.

(56) References Cited

OTHER PUBLICATIONS

Non-Final Office Action for U.S. Appl. No. 14/925,893 dated Feb. 25, 2016, 37 pages.
Final Office Action for U.S. Appl. No. 14/925,893, dated Apr. 26, 2016, 29 pages.
Non-Final Office Action for U.S. Appl. No. 14/925,893 dated May 16, 2016, 13 pages.
Non-Final Office Action for U.S. Appl. No. 14/925,899 dated Jan. 5, 2016, 21 pages.
Non-Final Office Action for U.S. Appl. No. 14/925,899 dated Apr. 14, 2016, 25 pages.
Non-Final Office Action for U.S. Appl. No. 14/927,213 dated Feb. 25, 2016, 33 pages.
Notice of Allowance for U.S. Appl. No. 14/927,213 dated May 11, 2016, 12 pages.
Non-Final Office Action for U.S. Appl. No. 14/925,899 dated May 25, 2016, 18 pages.
Supplementary Search Report and Opinion for EP 14764844, dated Jul. 28, 2016, 12 pages.
Non-Final Office Action for U.S. Appl. No. 15/145,739 dated Jul. 27, 2016, 22 pages.
Notice of Allowance for U.S. Appl. No. 14/925,893, dated Jul. 20, 2016, 9 pages.
Notice of Allowance for U.S. Appl. No. 14/925,899, dated Aug. 3, 2016, 9 pages.
Non-Final Office Action for U.S. Appl. No. 15/061,648 dated Jul. 12, 2016, 47 pages.
Non-Final Office Action for U.S. Appl. No. 14/449,865 dated Feb. 3, 2016, 9 pages.
International Search Report for PCT/CN2014/091362, dated Apr. 3, 2015, 2 pages.
Non-Final Office Action for U.S. Appl. No. 15/187,618, dated Aug. 18, 2016, 13 pages.

* cited by examiner

ELECTRIC CANDLE HAVING FLICKERING EFFECT

CROSS REFERENCE TO RELATED APPLICATIONS

The present application claims priority from provisional application No. 62/487,569, filed Apr. 20, 2017, the entire disclosure of which is hereby incorporated by reference in its entirety.

TECHNICAL FIELD

The field of the invention is electronic lighting devices, and in particular, electric candles.

BACKGROUND

The background description includes information that may be useful in understanding the present invention. It is not an admission that any of the information provided herein is prior art or relevant to the presently claimed invention, or that any publication specifically or implicitly referenced qualifies as prior art under the law.

Various electric lights are known in the art. See, e.g., U.S. Pat. No. 8,132,936 to Patton et al., U.S. Pat. No. 8,070,319 to Schnuckle et al., U.S. Pat. No. 7,837,355 to Schnuckle et al., U.S. Pat. No. 7,261,455 to Schnuckle et al., U.S. Pat. No. 7,159,994 to Schnuckle et al., US 2011/0127914 to Patton et al., U.S. Pat. No. 7,350,720 to Jaworski et al.; US 2005/0285538 to Jaworski et al. (publ. December 2005); U.S. Pat. No. 7,481,571 to Bistritzky et al.; US 2008/0031784 to Bistritzky et al. (publ. February 2008); US 2006/0125420 to Boone et al. (publ. June 2006); US 2007/0127249 to Medley et al. (publ. June 2007); US 2008/0150453 to Medley et al. (publ. June 2008); US 2005/0169666 to Porchia, et al. (publ. August 2005); U.S. Pat. No. 7,503,668 to Porchia, et al.; U.S. Pat. No. 7,824,627 to Michaels, et al.; US 2006/0039835 to Nottingham et al. (publ. February 2006); US 2008/0038156 to Jaramillo (publ. February 2008); US 2008/0130266 to DeWitt et al. (publ. June 2008); US 2012/0024837 to Thompson (publ. February 2012); US 2011/0134628 to Pestl et al. (publ. June 2011); US 2011/0027124 to Albee et al. (publ. February 2011); US 2012/0020052 to McCavit et al. (publ. January 2012); US 2012/0093491 to Browder et al. (publ. April 2012); and US 2014/0218903 to Sheng.

However, there is still a need in the art for improved electric candles and other lighting devices that generate a flickering flame effect.

SUMMARY OF THE INVENTION

The present invention provides apparatus, systems, and methods in which an electronic lighting device (e.g., an artificial candle) comprises a structure that helps to simulate a real candle flame, preferably in the look of a traditional candle.

One should appreciate that the disclosed subject matter provides many advantageous technical effects including providing various designs of an artificial candle that simulate a real candle light. Thus, many drawbacks of conventional methods of providing an artificial candle can be reduced, and even possibly eliminated, by the disclosed subject matter.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1A:
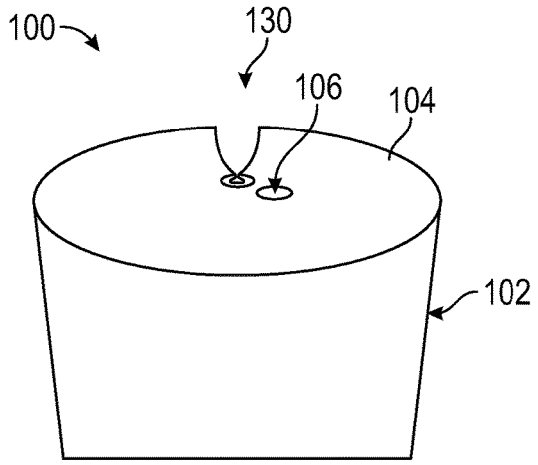
FIGS. 1A-1D are perspective, top, vertical cross-section, and exploded views, respectively, of one embodiment of an electronic lighting device.
Figure 1B:
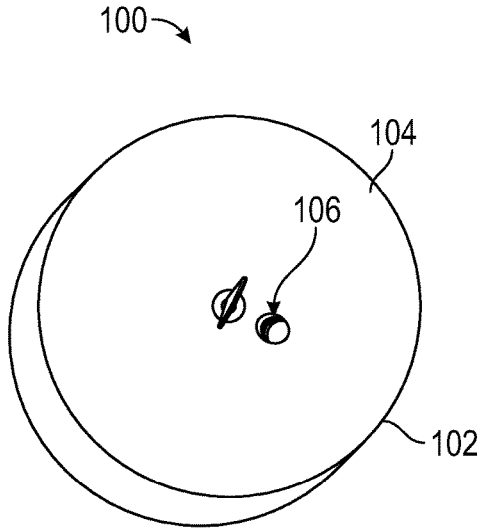
Figure 1C:
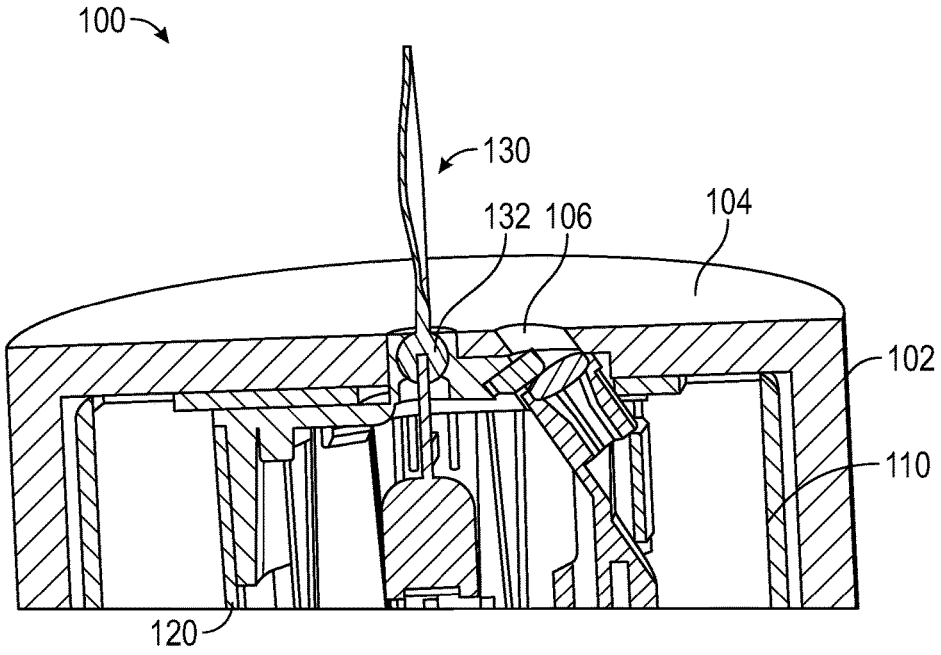
Figure 1D:
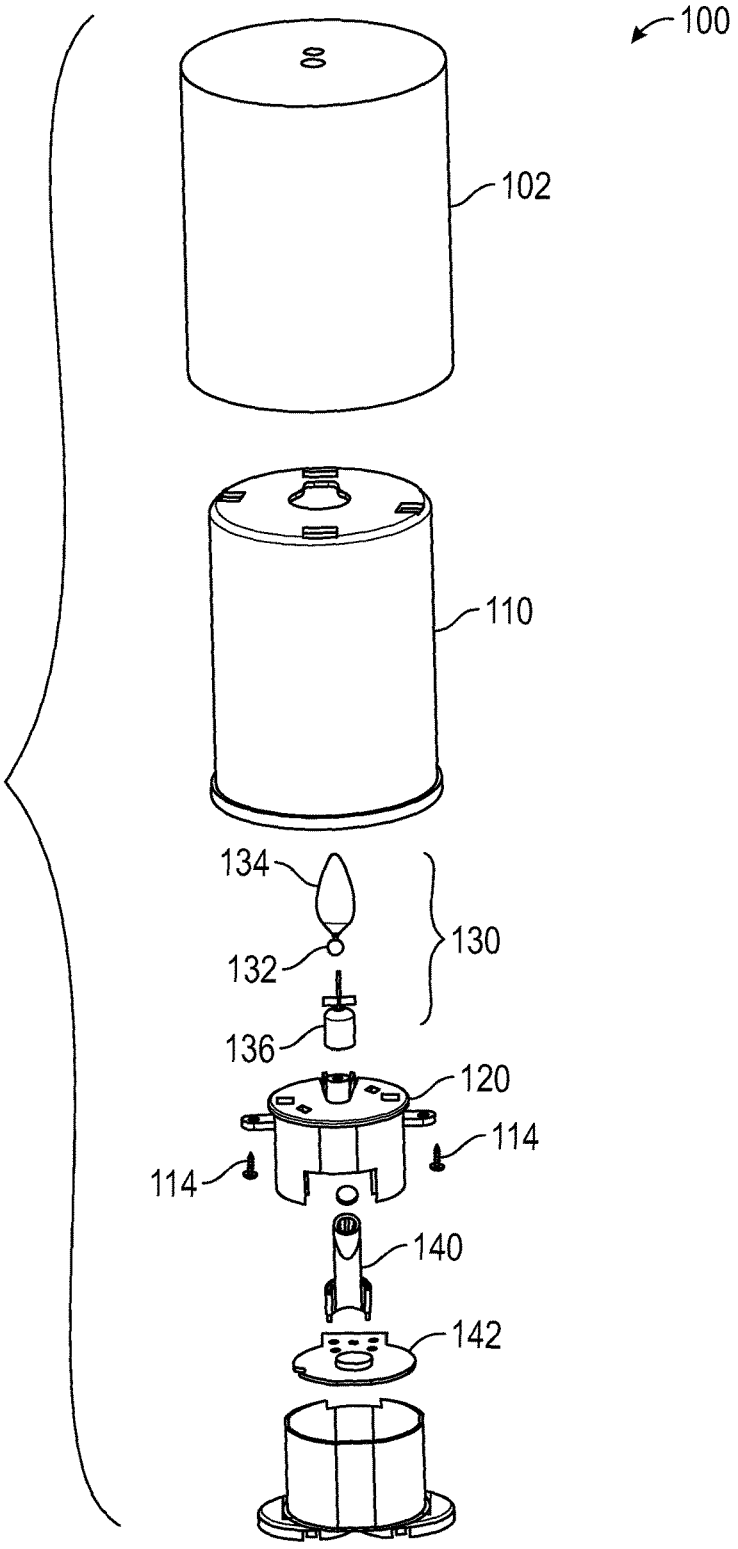
Figure 2A:
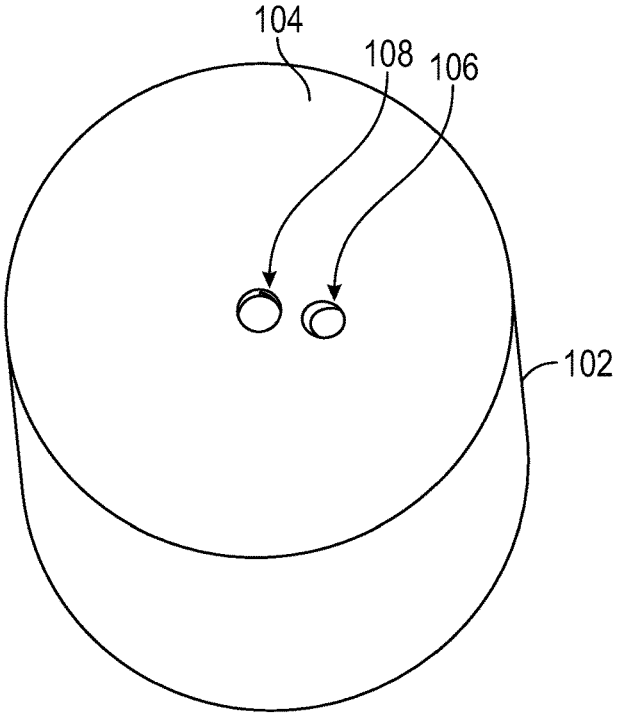
FIGS. 2A-2B are top, perspective and bottom, perspective views, respectively of an embodiment of an outer shell of the electronic lighting device shown in FIG. 1A.
Figure 2B:
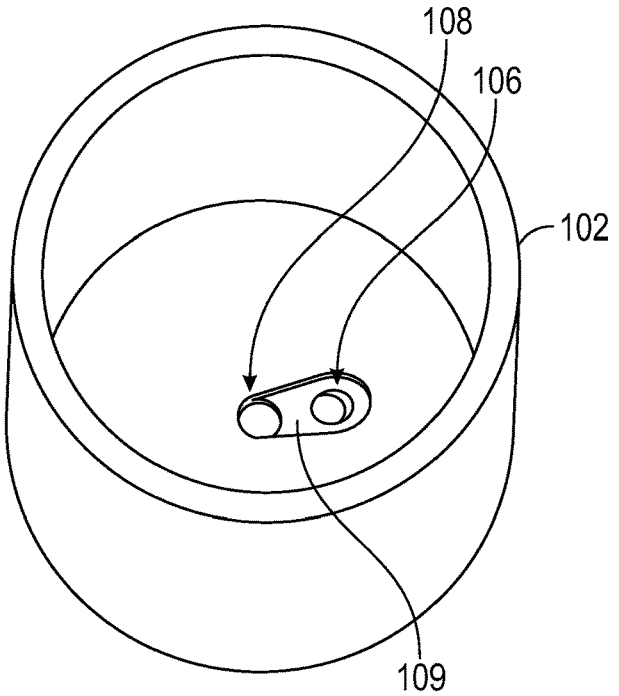
Figure 3A:
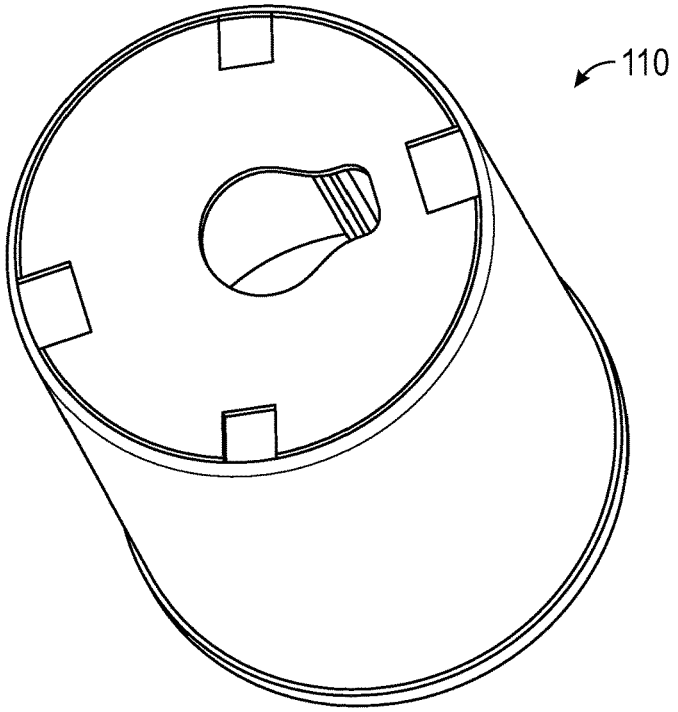
FIGS. 3A-3B are top, perspective and bottom, perspective views, respectively of an embodiment of an inner shell of the electronic lighting device shown in FIG. 1A.
Figure 3B:
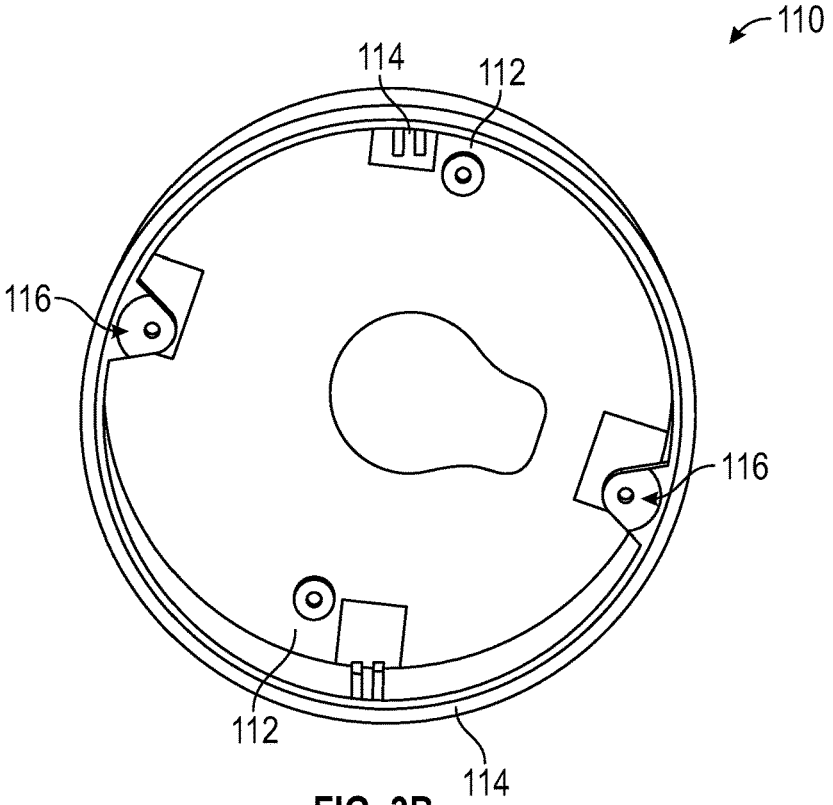

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In FIGS. 1A-6, an embodiment of an electric lighting device 100 is shown that is shaped like a traditional, wax candle. The device 100 comprises an outer wax or wax-like shell 102 having an aperture 106 in the upper surface 104 through which light from a light source can be emitted. The upper surface can include a second aperture 108, and in other embodiments described below, could alternatively comprise a divot or recess into which the flame element is mounted. As shown best in FIG. 2B, the bottom of the upper surface preferably comprises a recessed area 109 near or adjacent to the one or more apertures, which can act as a guide to ensure proper installation of housing 130 into the recessed area 109. FIG. 1C shows how the housing 130 is held into the surfaces of that recessed area 109. Preferably, the outer shell 102 comprises a cylindrical shape, but could be differently shaped without departing from the scope of the invention. In one embodiment, the flame element can have a hollow interior.

The outer shell 102 is preferably injection molded using a wax or wax composite. Alternatively, the outer shell 102 could be formed via extrusion or other manners, some of which are described in co-pending application having Ser. No. 15/096,061 filed on Apr. 11, 2016.

The device 100 further comprises an inner shell 110 sized to be disposed within the outer shell 102. The inner shell 110 preferably comprises an injection-molded piece that includes one or more receptors 112 for fasteners. Advantageously, the housing 120 can thereby be secured to the inner shell 110 using fasteners such as screws 114 shown in FIG. 1D, which reduces the amount of internal structure required to support the components utilized to produce the flickering flame effect.

As an alternative embodiment, the inner and outer shells could comprise a single injection molded piece that includes the receptors. This advantageously reduces the overall cost of manufacture and simplifies the assembly process. Further discussion of these concepts can be found in co-pending patent application having Ser. No. 15/096,061 filed on Apr. 11, 2016.

The inner shell 110 can include one or more keyways 115 that can be used to ensure proper alignment of components disposed within the inner shell 110. The inner shell 110 can further include one more receptors 116 for fasteners, which allow for a base of the device 100 to be coupled with the inner shell 110.

A housing 120 can be disposed within the inner shell 110, and configured to support the flame element 130. An upper surface 122 of the housing 120 preferably is shaped to mate with the recessed area 109 of the outer shell 102.

Figure 4A:
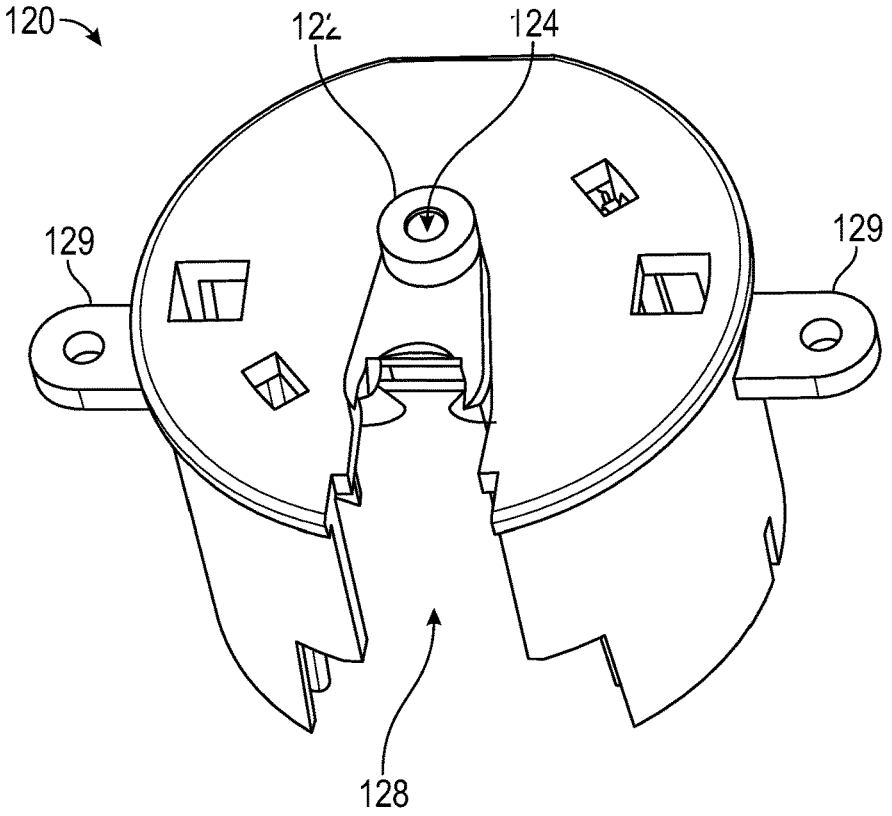
FIGS. 4A-4D are top perspective, bottom perspective, first vertical and second vertical cross-section views, respectively, of a housing of the electronic lighting device shown in FIG. 1A.
Figure 4B:
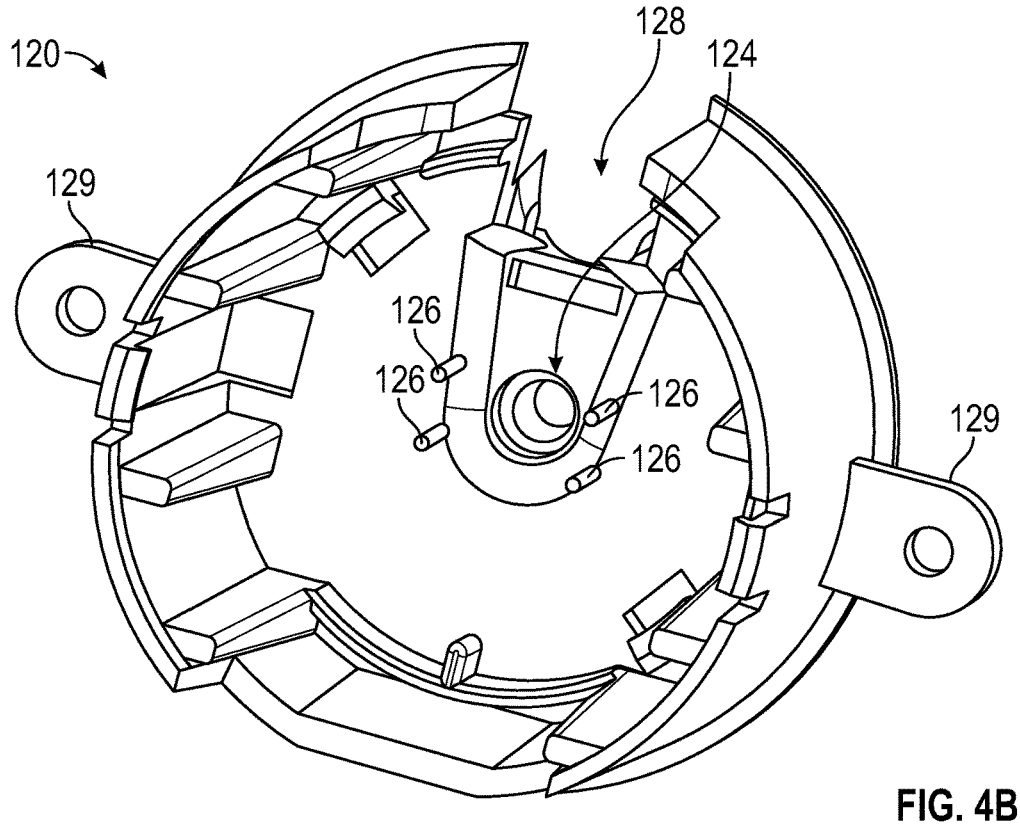
Figure 4C:
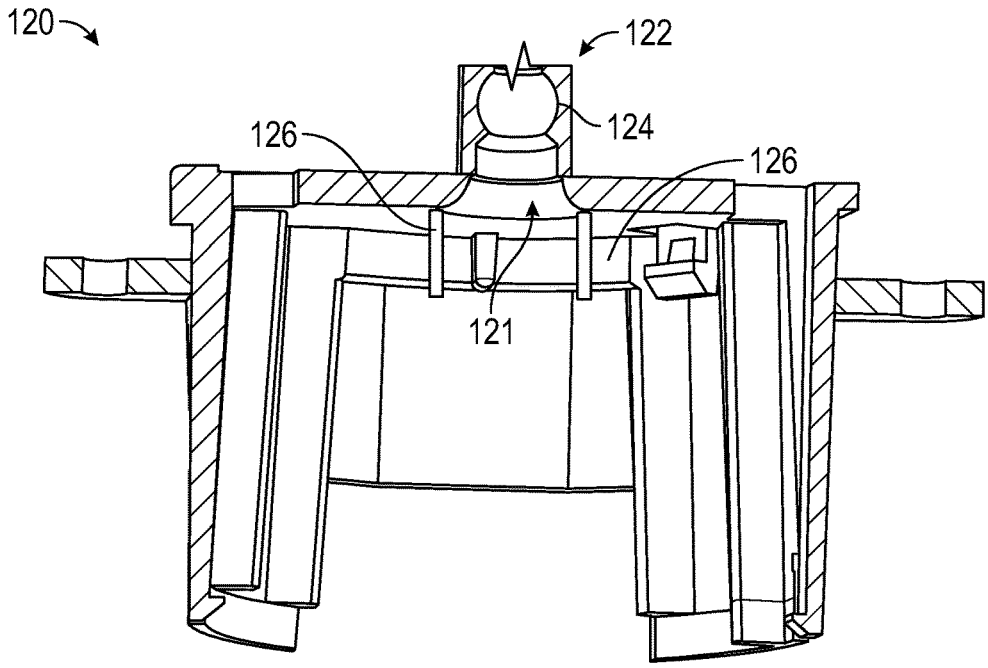
Figure 4D:
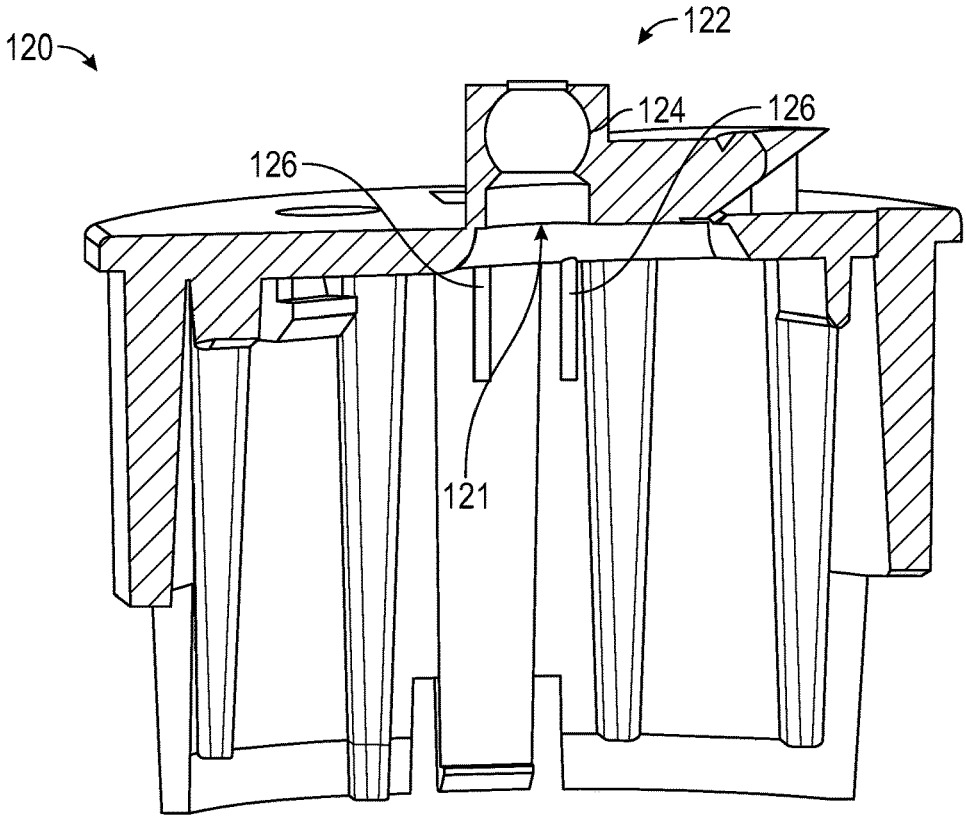
Figure 5A:
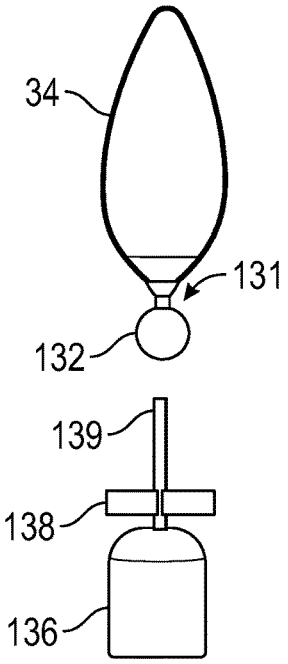
FIGS. 5A-5C are various exploded views of one embodiment of a pendulum member of the electronic lighting device shown in FIG. 1A.
Figure 5B:
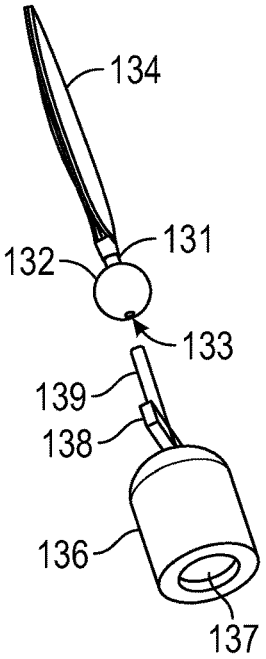
Figure 5C:
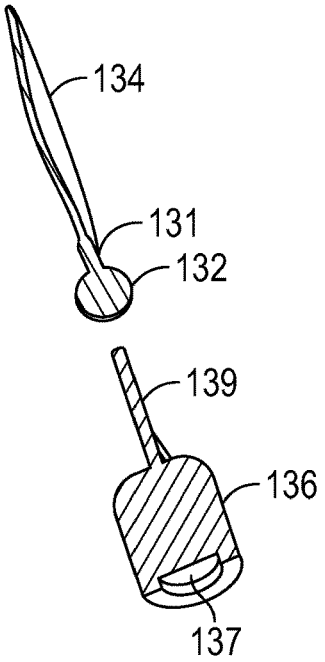
Figure 6:
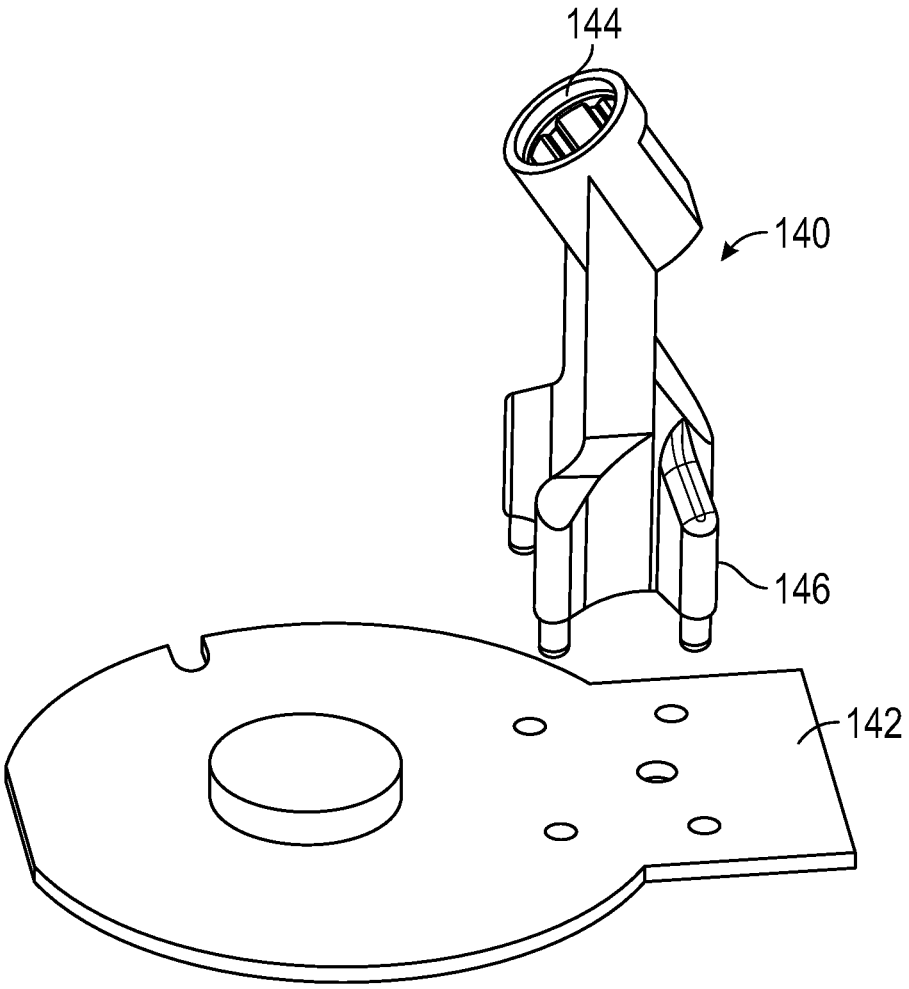
FIG. 6 is a perspective view of one embodiment of a light source holder and a circuit board of the electronic lighting device shown in FIG. 1A FIGS. 7A-7D are various cross-section views of a second embodiment of an electronic lighting device.
Figure 7A:
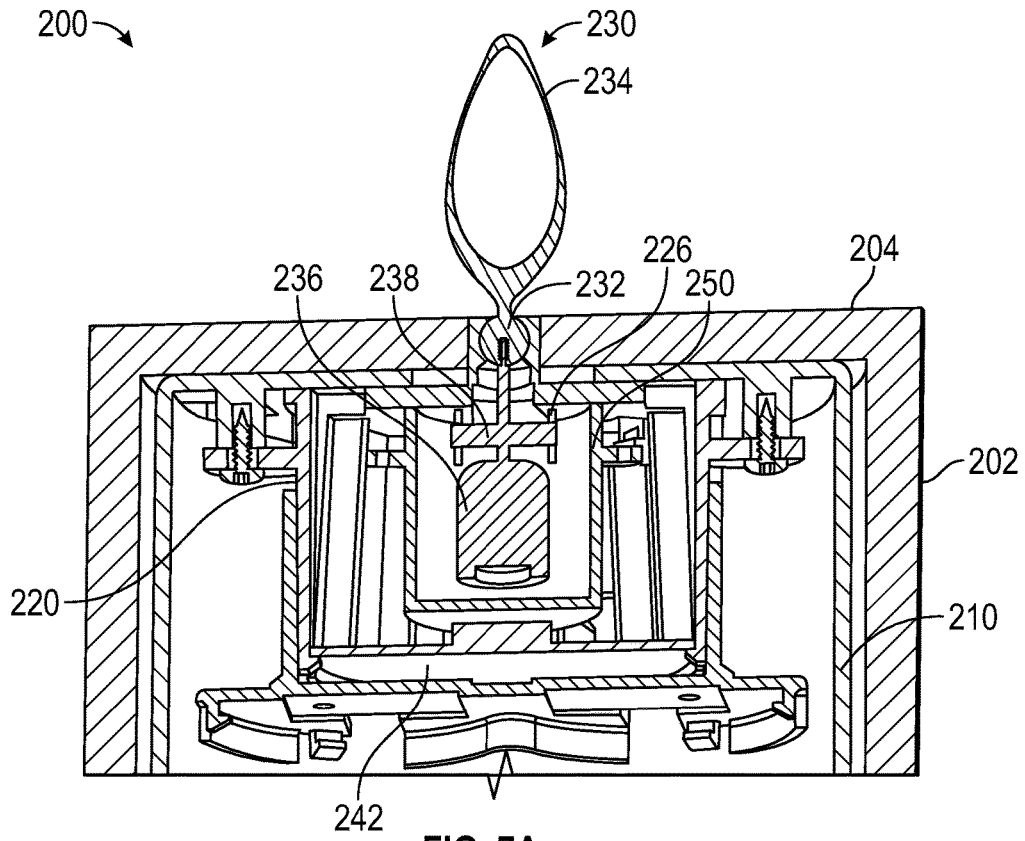
Figure 7B:
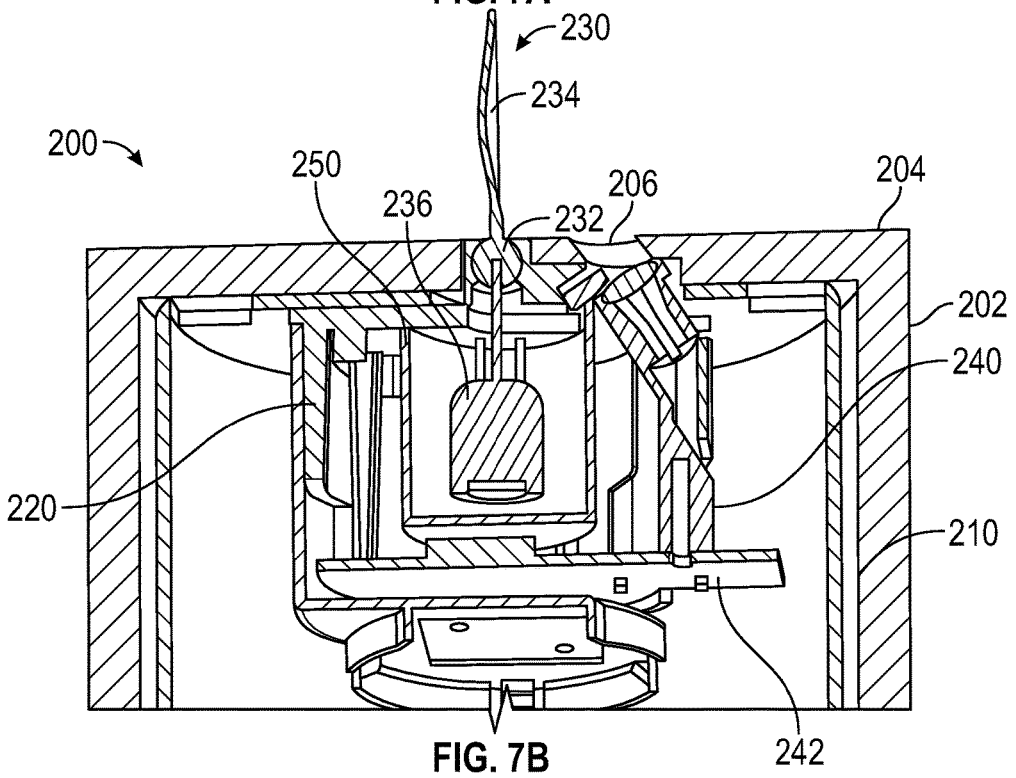
Figure 7C:
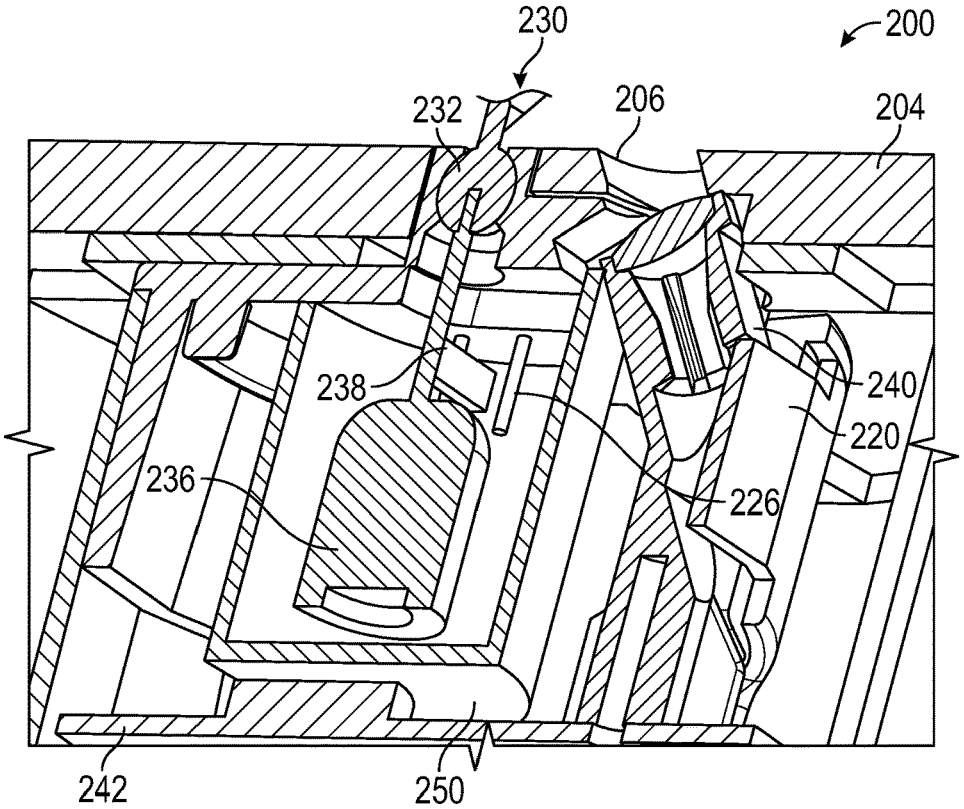
Figure 7D:
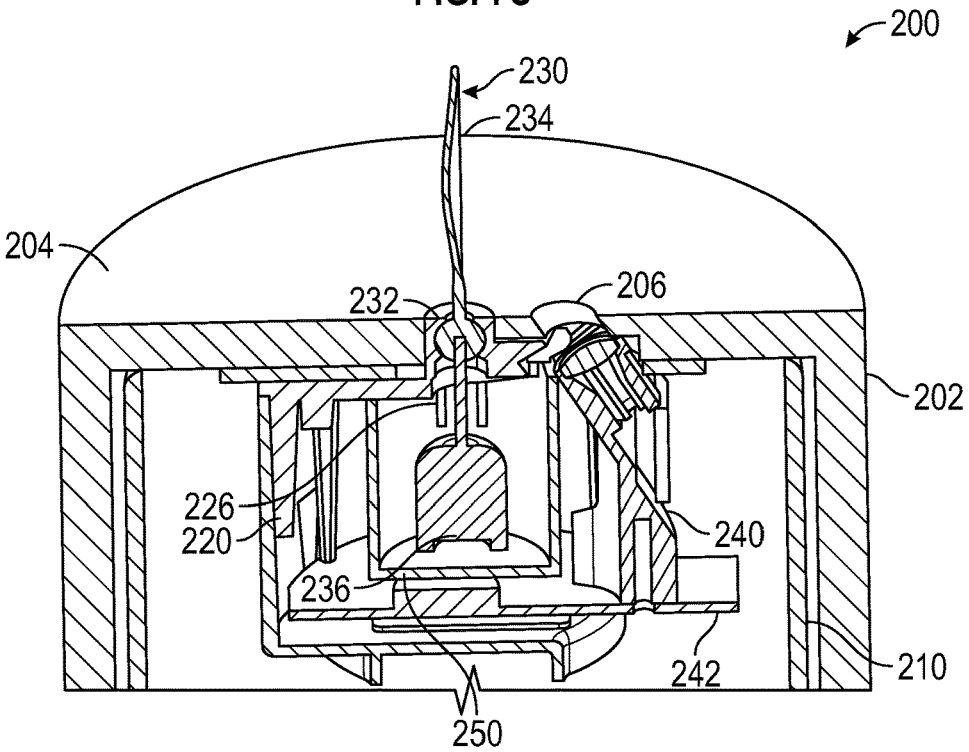

The upper surface 122 preferably comprises a socket or cup 124 configured to receive and support a spherical body (ball) 132 of the flame element 130. The flame element can act as a pendulum member. This is best shown in FIGS. 4C and 4D. Once inserted, the ball 132 can move within the socket 124, which in turns move the flame-shaped portion 134 of the pendulum member 130. To limit movement of the flame element 130 within the housing 120, the housing 120 can include one or more projections 126 that restrict overall movement of the flame member 130 by preventing movement outside a defined area or region. In an alternative embodiment, flexible wires or other material could be used to act as a spring or bias to limit movement of the flame member 130 and supply a force to help return the pendulum member 130 to a steady state position.

It is contemplated that the spherical body 132 can comprise regions having a material with a lower coefficient of friction that the rest of the body 132 such that friction between the body 132 and socket 124 can be reduced. It is also contemplated that the body 132 can include raised portions or bumps that preferably comprise a different material to reduce friction between the body 132 and socket 124.

By using a ball/socket combination, the illusion of a flickering flame is further accented by eliminating a visible hole in the upper surface 104 of the outer shell 102 where the flame member is located and that found in many prior art devices, and concealing the structure that holds the flame member in place and provides for its movement.

The housing 120 can further include a cut-out 128 where a light source can be mounted separately from the housing 120, and preferably be inserted into place once the housing 120 is coupled to the inner shell 110. Housing 120 can also include receptors 129 that align with receptors 112 of the inner shell 110, such that the housing 120 can be coupled to the inner shell 110 using one or more screws 114 or other fasteners.

Flame element 130 preferably comprises upper and lower portions, with the upper portion 134 having a flame-shaped appearance connected to a spherically-shaped lower piece 132 by a thinner middle portion 131. It is contemplated that the middle portion 131 could have a dark color to thereby resemble a wick. The lower portion can include a projection 139 extending from a base 136, with the projection 139 sized and dimensioned to be inserted into the opening 133 of the ball or spherical region 132. It is contemplated that the projection 139 can be secured within the spherically-shaped lower piece 132 via a friction-fit, snap-fit, or be screwed into the lower piece 132, to thereby prevent unintentional disconnection of the upper and lower portions. The flame element 130 is partially housed within the housing 120, such that the flame element 130 is allowed to move in a manner that simulates a moving flame. A detailed description of embodiments of a flame element and housing can be found in co-pending application having Ser. No. 14/819,146.

Preferably, the base 136 of the flame member 130 is sized and dimensioned to be larger in diameter than a diameter of the aperture 121 in the housing 120. In this manner, when the base 136 is coupled to the upper portion, the upper portion is prevented from being removed from the device 100 because the base 136 cannot pass through the aperture 121. Base 136 can also be configured to receive a magnet in recess 137. In this manner, the magnet can interact with a magnetic field generated by an electromagnet, for example, to thereby cause movement of the flame member 130.

Flame member 130 can further include one or more wings 138, which in conjunction with projections 126 or other structure limits movement of the pendulum member 130 with respect to the housing 120.

Device 100 can further include a light source holder 140 that preferably attaches to a circuit board or circuit board cover 142 via support bracings 146 that protrude from the bottom end of the holder's column. The support bracings can be inserted into holes on the board or cover 142. The support bracings are configured to stabilize the column and light source against the circuit board such that the angle and position of the light source advantageously remains stationary once installed. In a preferred embodiment, it is contemplated that the holder 140 can be secured in place via a screw or other fastener(s) to prevent movement of the holder 140 once installed.

The light source holder 140 preferably includes four support bracings that are spread evenly around the column and protrude in different angles from the column. It is contemplated that the column could be attached with any material or mechanism suitable for stabilizing the holder, and it is further contemplated that there could be any number of support bracings. The support bracings preferably have flat bottoms that lay against the circuit board and each support bracing can have a small pin protrusion that can fit in an aperture in the circuit board to provide more stability. It is contemplated that the support bracings and column can be manufactured as a single piece via injection molding. By creating the support bracings and column as a single piece, the overall complexity of the device is significantly reduced. By forming the support bracings and column as a single piece, the number of parts is reduced, simplifying assembly (e.g., by robotic or human assembly lines).

The light source holder 140 preferably comprises a light source, a lens, a column, and support bracings. The column has a bottom end and an angled top end. The angled top end is configured to receive the light source and the lens, and preferably includes a recess 144 to receive and support a lens to direct light from a LED or other light source against the flame-shaped piece 134 of the flame member 130. The angle of the angled end is configured with respect to the flame element 130 to precisely create the effect of a real candle. It is contemplated that the column could be of any shape (e.g., cylindrical, rectangular, etc.). Further discussion concerning the light source holder can be found in application having Ser. No. 62/267,168 filed on Dec. 14, 2015.

Circuit board 142 can control a drive mechanism, which could be an electromagnet, a fan, or other component that creates kinetic motion on the flame element to simulate the movement of a moving flame.

FIGS. 7A-7D illustrate another embodiment of an electric lighting device 200 comprising a cap 250 that is coupled to the housing 220 or shell 202, and configured to encapsulate the base 236 of the flame/pendulum member 230. The cap also holds circuit board 242, which includes a light source mounted on the circuit board. The cap 250 advantageously restricts a motion of the pendulum member 230 while also sealing the aperture in the upper surface 204 of shell 202. It is especially preferred that the cap 250 be affixed to the shell 202 via ultrasonic welding or other commercially suitable manner. In such embodiments, housing 220 could be eliminated as well as inner shell 210. Cap 250 preferably comprises a plastic or other material that will have little to no impact on the magnetic field generated by the electromagnet. In one embodiment shown in FIG. 7A, the flame member 230 can include wings 226, or any of the other projections shown in FIGS. 5A-5C.

Figure 8A:
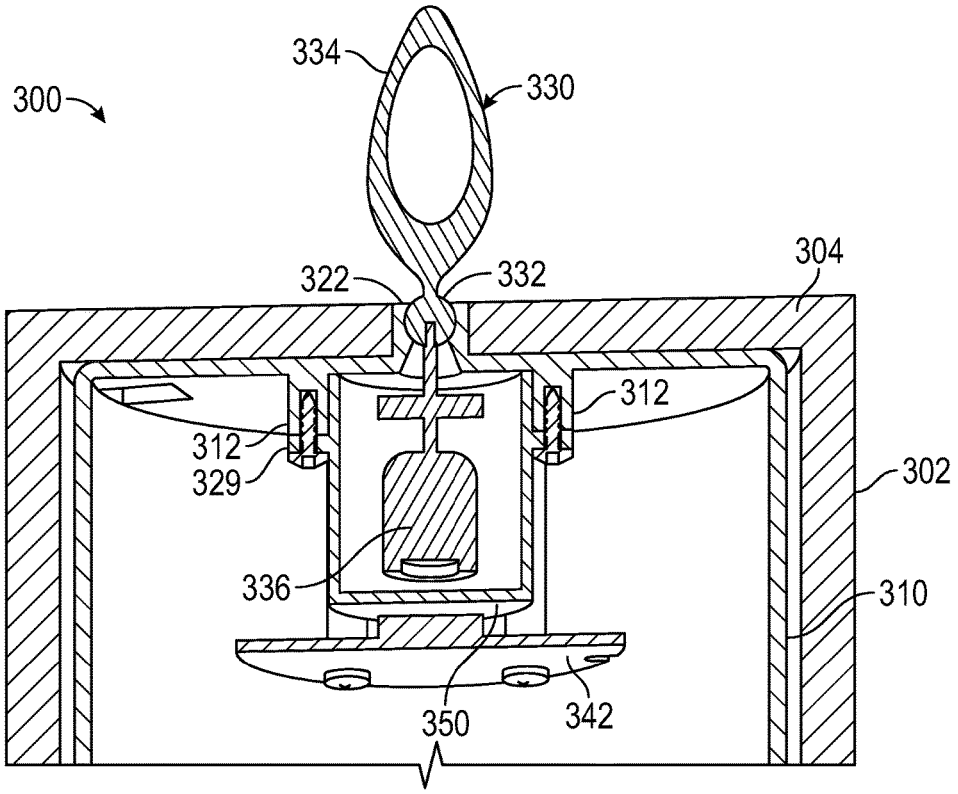
FIGS. 8A-8B are cross-section views of a third embodiment of an electronic lighting device.
Figure 8B:
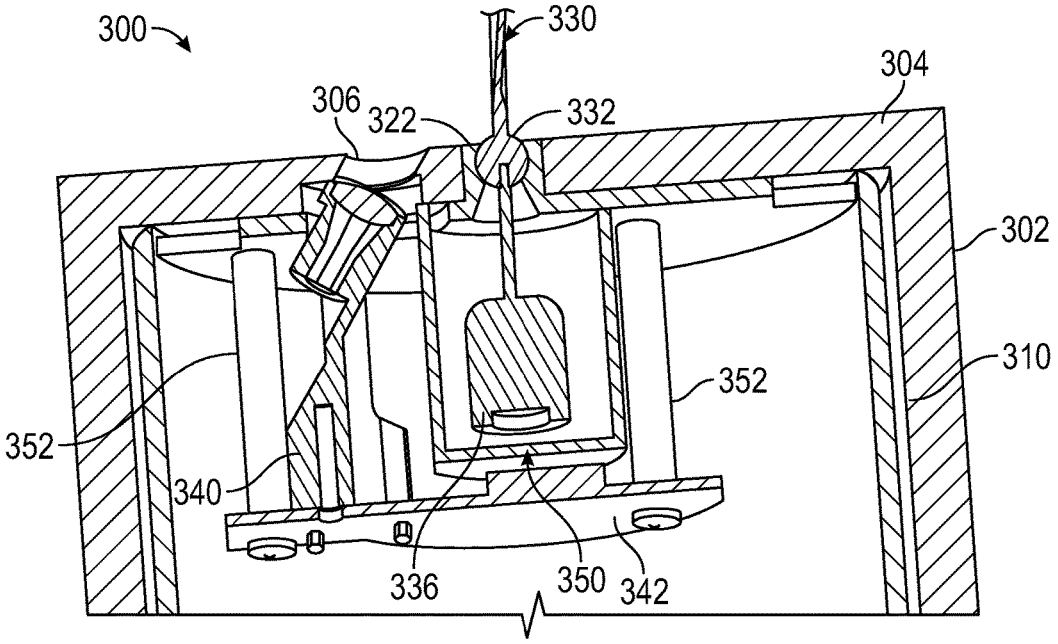

FIGS. 8A-8B illustrate yet another embodiment of an electric lighting device 300, in which the housing has been eliminated. This advantageously reduces the number of components required for manufacture and simplifies assembly of the device 300, thereby reducing overall cost of manufacture. Cap 350 is coupled to the inner shell 310 via fasteners that extend through receptors 329 of the cap 350 and receptors 312 that are integral with the inner shell 310. With the housing eliminated, the circuit board 342 can be coupled to the inner shell via supports 352. Preferably, an electromagnet and light source holder 340 are disposed on the board 342 and supported by inner shell 310. With respect to the remaining numerals in FIGS. 8A-8B, the same considerations for like components with like numerals of FIGS. 1A-1D apply.

Figure 9:
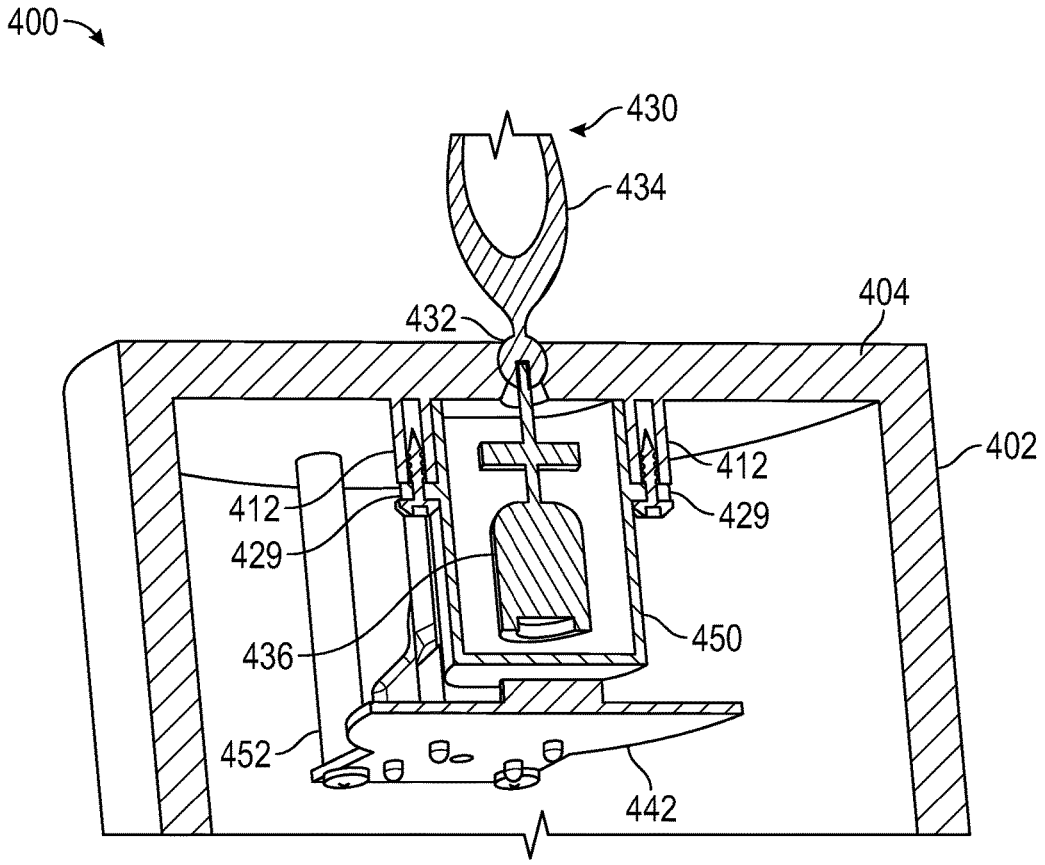
FIG. 9 is a cross-section view of a fourth embodiment of an electronic lighting device.

In still further embodiments shown in FIG. 9, both the housing and inner shell can be eliminated from the device 400, leaving the outer shell 402. In such embodiments, it is contemplated that the cap 450 can be attached directly to the outer shell 402 via fasteners that are inserted into receptors 429 and 412. Similarly, the circuit board 442 can be attached to the outer shell 402 via supports 452. With respect to the remaining numerals in FIG. 9, the same considerations for like components with like numerals of FIGS. 1A-1D apply As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Thus, it should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. An electric lighting device, comprising:

a circuit board, having electronic circuitry thereon;

a support coupled to the circuit board;

a light source support coupled to the circuit board and configured to receive and support a light source;

a housing comprising an internal cavity, wherein the housing is configured to couple to the supports and to hold the supports; and a flame element coupled to the housing such that the flame element is movable with respect to the housing and where the light source support faces towards the flame element further comprising an electromagnet located on the light source, the electromagnet interacting with the flame element, and causing the flame element to move.

2. The electric lighting device as in claim 1, wherein further comprising at least one circuit on the circuit board which controls energization of the electromagnet to move the flame element.

3. The electric lighting device as in claim 2, further comprising an arm connected to the flame element, the arm extending inside the housing, and wherein said arm includes a magnetic element at a distal portion thereof and where the electromagnet in the housing causes pendulum like movement of the flame element.

4. An electric lighting device, comprising:

a flame member operating to move like a pendulum, having a upper portion having a flame-shaped appearance, and a spherical body portion disposed beneath the upper portion; and a housing comprising a socket configured to receive the spherical body portion, and to allow the spherical body portion to move within the socket, wherein the flame member also includes an arm extending from the spherical body portion in it opposite direction from the flame member; and an arm moving device, in the housing, causing the arm to move and thereby causing the flame member to move.

5. The electric lighting device as in claim 4, further comprising a light source, coupled to said housing, and directing light onto a surface of the flame member.

6. The electric lighting device as in claim 5, further comprising a circuit board, mounted in the housing, wherein the light source is on a holder, and where the holder is connected to the circuit board.

7. The device of claim 4 wherein the arm comprises a first wing configured to restrict movement of the arm of the flame member.

8. The device as in claim 4, wherein a portion on the arm includes a magnet, and further comprising an electromagnet which interacts with the arm to move the flame portion.

9. The device as in claim 6, wherein a portion on the arm includes a magnet, and further comprising an electromagnet, mounted on the circuit board, which interacts with the arm to move the flame portion.

* * * * *